US006150983A

United States Patent [19]

Massey

[11] Patent Number: 6,150,983

[45] Date of Patent: Nov. 21, 2000

[54] DEVICE FOR RECEIVING AND/OR TRANSMITTING ELECTROMAGNETIC RADIATION

[75] Inventor: Peter J. Massey, Crawaley, United Kingdom

[73] Assignee: U.S. Philips Corporation, New York, N.Y.

[21] Appl. No.: 08/899,942

[22] Filed: Jul. 24, 1997

[30] Foreign Application Priority Data

Jul. 29, 1996 [DE] Germany ..... 196 30 505

[51] Int. Cl.[7] ..... H01Q 1/27; H01Q 15/24; H01P 1/161

[52] U.S. Cl. ..... 343/702; 343/756; 343/858; 333/21 A; 333/125; 333/127; 333/136

[58] Field of Search ..... 333/125, 126, 333/127, 129, 134, 136, 21 A; 343/702, 756, 858

[56] References Cited

U.S. PATENT DOCUMENTS 4,245,198 1/1981 Nishikawa et al. ..... 333/136
4,449,108 5/1984 Endo et al. ..... 333/134 X
4,595,890 6/1986 Cloutier ..... 333/21 A X
4,902,991 2/1990 Ishikawa et al. ..... 333/126
5,023,866 6/1991 De Muro ..... 333/126 X
5,440,279 8/1995 Kinoshita et al. ..... 333/21 A X
5,774,093 6/1998 Schiltmans ..... 333/21 A X

*Primary Examiner*—Benny T. Lee
*Attorney, Agent, or Firm*—Dicran Halajian

[57] ABSTRACT

A device for receiving and/or transmitting an electromagnetic oscillation is described utilizing an antenna element and at least two wave-guiding assemblies which are each connected to a connection point of the antenna element via a respective supply device, and which are otherwise mutually insulated with respect to the electromagnetic oscillation. Each assembly comprise a conductor part which is coupled to the associated supply device in each of the wave-guiding assemblies for the transmission of the electromagnetic oscillation. The wave-guiding assemblies are designed for receiving and/or transmitting the electromagnetic oscillation via the supply device, and the conductor parts are constructed for receiving and/or radiating the electromagnetic oscillation in a manner comparable to the manner in which the antenna element operates. This device has a plurality of antennas without an appreciable increase in expenditure compared with a similar device having a single antenna element.

20 Claims, 4 Drawing Sheets

DEVICE FOR RECEIVING AND/OR TRANSMITTING ELECTROMAGNETIC RADIATION

DESCRIPTION

BACKGROUND OF THE INVENTION

This invention relates to a device for receiving and/or transmitting electromagnetic radiation.

A portable receiver or transceiver device is known from EP-0 214 806 A2 which carries out its reception with a plurality of antennas. This portable transceiver device comprises a narrow-band, planar strip conductor antenna which is connected to a first receiver. Furthermore, a wide-band rod antenna is connected to an associated switching unit, and a second receiver and a transmitter are both connected to the wide-band antenna via the switching unit ("duplexer"). The planar strip conductor antenna is formed from a conductive radiating plate (layer) with a conductive ground layer or plate. The two are interconnected by a conductive connecting plate or layer. A housing surrounding the transmitter and receiver comprises an earpiece and a microphone in its front and the strip conductor antenna under its rear surface. The rod antenna is mounted vertically on the upper side of the housing.

The plurality of antennas used in this portable transceiver device has the object of reducing fading and noise effects in the reception mode. It is the object of the use of two different types of antennas to ensure that the antennas will not adversely affect one another and that the portable transceiver device does not become unnecessarily heavy and cumbersome.

U.S. Pat. No. 4,721,962 discloses an antenna for a transceiver device which requires no transmitter/receiver switching unit, typically a cordless telephone. This antenna is formed by a printed circuit board which is subdivided into three mutually adjoining regions by two separating gaps which lie in different planes. These regions are a first end region, which adjoins a first gap, a second end region which adjoins a second gap, and an intermediate or central region between the gaps. Electrically conductive surfaces or conductor tracks are connected across the gaps by means of elements having a high impedance to high frequencies such as, for example, high-ohmic resistors or choke coils. A high-frequency unit is preferably arranged below the central region of the printed circuit board and comprises a transmitter output stage which is connected to a first of the regions of the printed circuit board, which forms an antenna, while the intermediate region and the other end region of the printed circuit board form the director and reflector element, respectively. A receiver input of the high-frequency module is connected to the other end region which forms a receiver antenna, while the intermediate region and the first end region form a director and a reflector element, respectively. The high-frequency connections to the respective antennas are arranged adjacent the separating gaps.

This antenna arrangement is designed to be particularly suitable for use in portable (cordless) telephones, having the advantageous properties of a rod antenna while requiring no additional space in the housing of the telephone and comprising no parts projecting from this housing. A plurality of, for example, receiver antennas for a simultaneous reception with the purpose of suppressing noise and fading, however, is not formed by this antenna arrangement.

SUMMARY OF THE INVENTION

The invention has for its object to provide a device for receiving and/or transmitting an electromagnetic oscillation which comprises a plurality of antennas without causing an appreciably increased expenditure compared with such a device having a single antenna element.

According to the invention, this object is achieved by means of a device for receiving and/or transmitting an electromagnetic oscillation (i.e. high frequency electromagnetic radiation) with an antenna element and at least two wave-guiding assemblies which are each connected to a connection point of the antenna element via a respective supply device, which are in other respects arranged to be mutually insulated (isoluted) with respect to the electromagnetic oscillation, and which each comprise a conductor part which in each of the wave-guiding assemblies is coupled to the associated supply device for transferring the electromagnetic oscillation, while the wave-guiding assemblies are designed for taking up and/or giving off the electromagnetic oscillation via the supply device, and the conductor parts are designed for taking up and/or radiating the electromagnetic oscillation in a manner similar to the manner in which the antenna element operates.

In the device according to the invention, therefore, receiving and transmitting of the electromagnetic oscillation is achieved by means of a plurality of antennas without a further antenna element having to be added as compared with the prior art. At the same time, the device according to the invention may be exactly similar to that according to the prior art as regards its external construction; in particular, a change in the external dimensions and shape known from the prior art is avoided. The user of such a device will thus not be confronted with any differences in operating the device, compared with the prior art. For the manufacturing process there is the advantage that the device according to the invention is of a very simple construction, because no additional, separate antenna element is required for transmitting and receiving by means of a plurality of antennas, as was described in EP 0 214 806 A2. This leads to a simple and inexpensive construction of the device for receiving and transmitting the electromagnetic oscillation, which is especially preferred, for example, when the device according to the invention is to be used in consumer applications, for example, as a mobile communication device, in particular a mobile telephone or the like. The invention in that case makes it possible in a simple manner effectively to reduce interfering influences of parts of the body of the user which are in the immediate vicinity of the device during operation. It is achieved in particular thereby that at all times at least one of the conductor parts or the antenna element is capable of transmitting or receiving electromagnetic oscillations during the correct use of the device according to the invention without being hampered in its function, by interfering influences from especially the hand of the user.

The device according to the invention achieves these advantages by departing from the principle according to which, in the prior art of EP 0 214 806 A2, the antenna element is always operated as a component radiating or receiving electromagnetic oscillations opposite an electrically conductive ground plane (which is accommodated in the housing of the device). Instead, the fixed assignment of certain electrical functions to individual components of the device is dispensed with; according to the invention, each of the conductor parts of the wave-guiding assemblies acts as a component for radiating or receiving the electromagnetic oscillations in addition to the antenna element. The oscillations may be given off or taken up between the wave-guiding assemblies by means of the configuration of antenna element and conductor parts and via the associated supply devices, and subsequently be processed further and evaluated by at least two different paths. It will then be possible at all times for at least one of the wave-guiding assemblies to send or receive an electromagnetic oscillation in the manner required for operation, even in the case of interferences or unfavorable transmission and in particular reception conditions.

Preferably, the wave-guiding assemblies each comprise a circuit arrangement for taking up and/or giving off the electromagnetic oscillation. These circuit arrangements may in particular comprise transmission or reception devices for the envisaged use of the device according to the invention, i.e. components which the device will have to comprise anyway. Accordingly, the wave-guiding assemblies are not components which are to be added for achieving the function according to the invention. The wave-guiding components in this embodiment of the invention may thus comprise the receiver and transmitter also present according to the prior art of EP 0 214 806 A2. Advantageously, the conductor parts of the individual wave-guiding assemblies utilized for taking up or giving off the electromagnetic oscillation function as a complement to the antenna element and each comprise a common electrical conductor for the circuit arrangement forming a part of the relevant wave-guiding assembly. These conductor parts are preferably formed by screens or ground planes of the wave-guiding assemblies. Since such screens and ground planes are always present, this embodiment of the device according to the invention can be realized without additional components.

In another embodiment of the device according to the invention, the conductor parts of the individual wave-guiding assemblies and/or the associated supply devices are designed for propagating portions of the electromagnetic oscillation which are linearly independent of one another. Preferably, the portions of the electromagnetic oscillation propagated in the individual wave-guiding assemblies are substantially perpendicular to one another. It can be achieved thereby in a simple manner that a portion of a received electromagnetic oscillation will always be present in at least one of the wave-guiding assemblies independently of the spatial position of the device according to the invention in the case of a reception of an electromagnetic oscillation, so that a reliable reception is always ensured, particularly in the example of a mobile telephone, even if the latter is freely handled. On the other hand, oscillation portions passed through the individual. wave-guiding assemblies may be superimposed at the connection point of the antenna element where the supply devices are joined together so as to form electromagnetic oscillations of various waveforms, in particular having various polarizations, in dependence on their respective weights. Although the operation with a plurality of antennas is preferably provided for the reception of electromagnetic oscillations, the plurality of antennas in the device according to the invention may also be utilized for joining together portions of an electromagnetic oscillation of different weights into a resulting electromagnetic oscillation, for example, in dependence on the spatial orientation of the device, which resulting oscillation has an at least substantially fixed waveform or polarization in relation to a spatially fixed system of co-ordinates. The construction of a device receiving the electromagnetic oscillations transmitted by the device according to the invention may be simplified thereby.

In an advantageous further embodiment of the device according to the invention, the conductor parts of the individual wave-guiding assemblies extend in mutually perpendicular directions with their portions which substantially define the waveform of the portions of the electromagnetic oscillation propagated therein. The mutually perpendicular arrangement of the portions of the electromagnetic oscillation in the individual wave-guiding assemblies is achieved thereby.

The conductor parts have main dimensions which are tuned to the wavelength of the electromagnetic oscillation so as to be able to perform their transmission and/or reception function for the electromagnetic oscillation in an advantageous manner. This tuning is accompanied by the equally advantageous tuning of the antenna element to the wavelength of the electromagnetic oscillation, which is also carried out. A determination of the dimensions of the conductor parts is achieved in that they are preferably only tuned to the wavelength of the electromagnetic oscillation to be received. The operation with a plurality of antennas is limited in that case to the major operation as a reiver of the electromagnetic oscillation.

Further advantageous embodiments of the device according to the invention can be found in the dependent claims.

BRIEF DESCRIPTION OF THE DRAWINGS

A few embodiments of the device according to the invention are shown in the drawing, in which corresponding elements have been given the same reference numerals. In the drawing.

DESCRIPTION OF THE PREFERRED EMBODIMENTS

Figure 1:
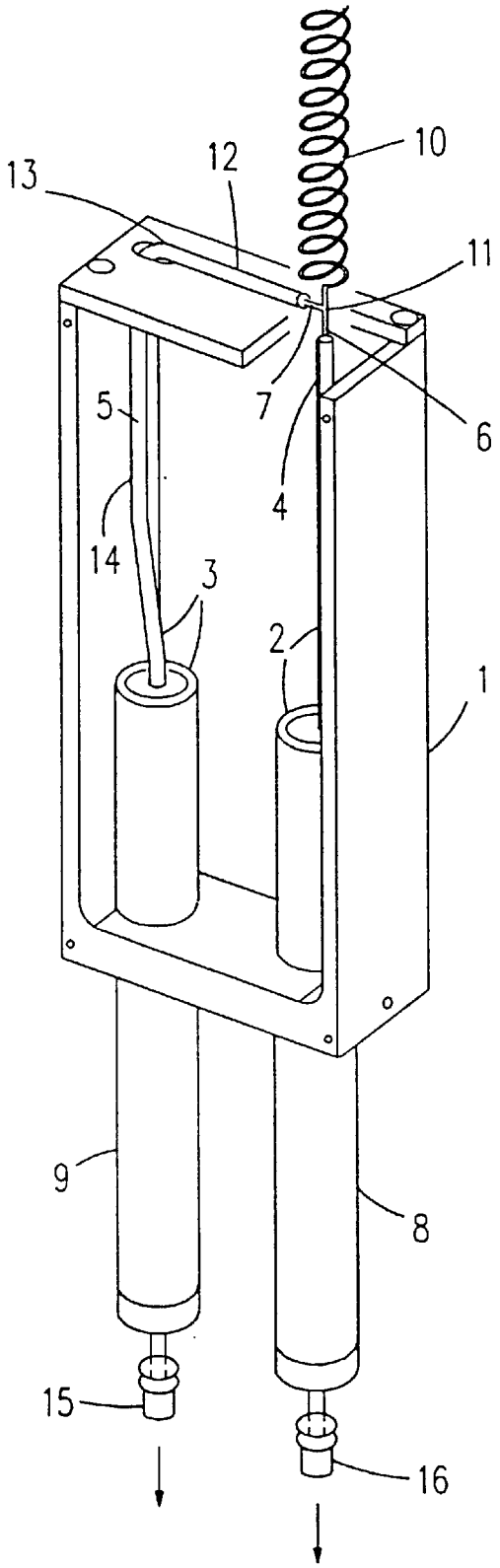
FIG. 1 shows a first embodiment of a device according to the invention.

FIG. 1 shows a simplified arrangement as a first embodiment of the device according to the invention in which a first and a second wave-guiding assembly 2, 3 are arranged in a substantially rectangular housing 1 which is preferably made from an electrically insulating material. In the interest of brevity and clarity, each of the wave-guiding assemblies 2, 3 in the drawing is represented in FIG. 1 merely as a section of a coaxial cable with a respective outer conductor 4, 5 and an inner conductor 6, 7, and with a respective coaxial high-frequency choke 8, 9. The coaxial cables 4, 6 and 5, 7, in particular the inner conductors 6, 7 thereof, form the supply devices for the wave-guiding assemblies 2, 3 and are connected to one another and to an antenna element 10 at the connection point 11 thereof. Except for this connection, the wave-guiding assemblies 2, 3 are arranged with mutual insulation (isolation) for the electromagnetic oscillations to be received or transmitted by them. The outer conductors 4, 5 of the coaxial cables form the conductor parts of the first and the second wave-guiding assemblies 2, 3, which conductor parts are designed for taking up and/or giving off the electromagnetic oscillation in a manner similar to that of the antenna element 10. The outer conductors 4, 5 are thus capable of radiating or receiving an electromagnetic oscillation in a manner similar to that of the antenna element 10. In the example of FIG. 1, they form rod-shaped antenna devices, whereas the antenna element 10 is helically coiled.

In FIG. 1, the antenna element 10 and the first coaxial cable 4, 6 of the first wave-guiding assembly 2 are arranged in one and the same direction, whereas the second coaxial cable 5, 7 of the second wave-guiding assembly 3 has a first portion 12 which is perpendicular to the direction of the common axis of the antenna element 10 and the first coaxial cable 4, 6. This first portion 12 is connected at one side to the connection point 11 via the inner conductor 7 and issues into a second portion 14, which extends at least substantially parallel to the axis of the first coaxial cable 4, 6, beyond an at least substantially perpendicular bend 13. The portions of the coaxial cables 4, 6 and 5, 7 which form the conductor parts of the wave-guiding assemblies 2, 3 used for radiation or reception, are bounded by the coaxial high-frequency chokes which prevent a further propagation of the electromagnetic oscillations to the outer conductors 4, 5 of the coaxial cables. At the ends of the coaxial high-frequency chokes 8, 9 facing away from the antenna element 10, the coaxial cables 4, 6 and 5, 7 issue into connection devices 15 and 16, for example coaxial plugs, for passing the electromagnetic oscillations on through the inner conductors 6 and 7 for further processing or for supplying electromagnetic oscillations towards the connection point 11.

Although the orientation of the device shown in FIG. 1 may be substantially arbitrary in a system of co-ordinates which is fixed in relation to the surroundings of this device, the alignment of the centerlines of the antenna element 10, the first coaxial cable 4, 6, and the second portion 14 of the second coaxial cable 5, 7 is denoted as "vertical", and the orientation of the first portion 12 of the second coaxial cable 5, 7 is denoted as "horizontal". This is merely done to simplify the ensuing description, but it does not imply any limitation in the orientation of the device according to the invention in its surroundings.

Figure 2:
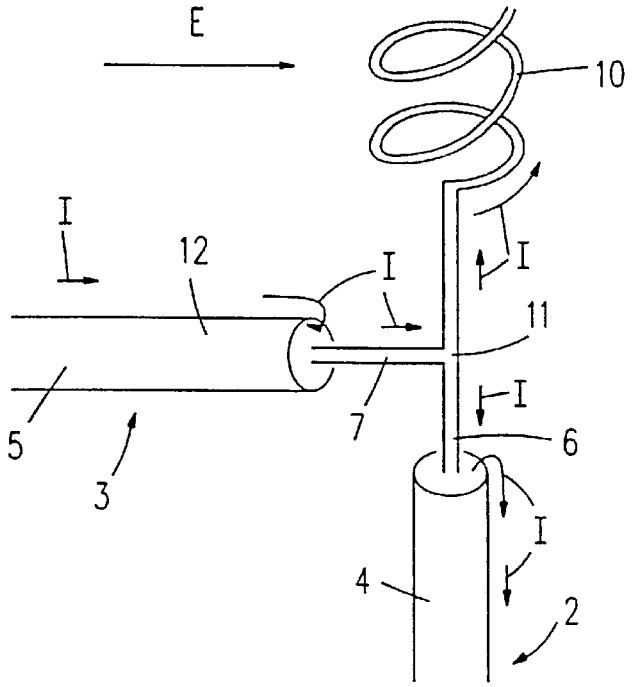
FIG. 2 shows an operating condition of the device shown in FIG. 1 where a received electromagnetic signal has a substantially horizontal polarization.

FIG. 2 shows a first operating condition of the device of FIG. 1, with an electromagnetic oscillation to be received thereby, whose electrical field vector E is horizontally oriented. The electromagnetic oscillation to be received is accordingly horizontally polarized. A current I is induced into the outer conductor 5 of the second coaxial cable 5, 7 in the horizontal first portion 12 thereof by the electric field with the horizontal electric field vector E. The current I in the outer conductor 5 also causes a current in the inner conductor 7 of the second coaxial cable 5, 7. An electromagnetic oscillation is generated thereby in the second coaxial cable 5, 7 of the second wave-guiding assembly 3. This oscillation is on the one hand supplied to the second connection device 15 through the second coaxial cable 5, 7 (the inner conductor 7 thereof), and on the other hand causes currents I both in the antenna element 10 and also in the first coaxial cable 4, 6, in particular the inner conductor 6 thereof. Thus the first wave-guiding assembly 2 also passes an electromagnetic oscillation in this operating condition, which oscillation is propagated through the inner conductor 6 towards the first connection device 16 and through the outer conductor 4 up to the coaxial high-frequency choke 8. FIG. 2, however, merely shows that portion of FIG. 1 which comprises the elements immediately surrounding the connection point 11 for greater simplicity.

Figure 3:
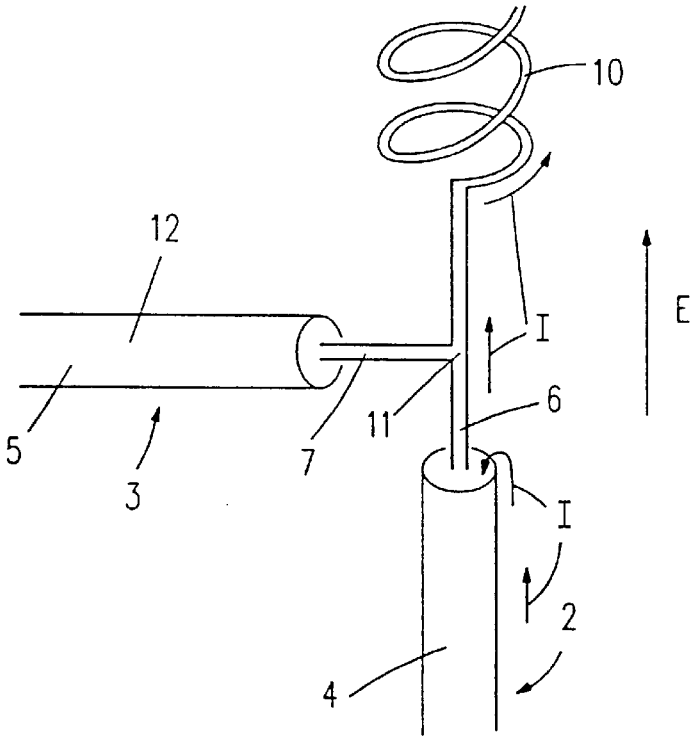
FIG. 3 shows another operating condition of the device shown in FIG. 1 where the received electromagnetic signal has a substantially vertical polarization.

FIG. 3 shows, in a manner similar to that of FIG. 2, a second operating condition with a vertically oriented electric field vector E, i.e. with a vertically polarized electromagnetic oscillation to be received. This generates a current I in the antenna element 10 and in the outer conductor 4 of the first coaxial cable 4, 6. A current is also generated in the inner conductor 6 again by the outer conductor 4. Given a corresponding dimensioning of the antenna element 10 and of the first coaxial cable 4, 6, the situation now arises as shown in FIG. 3, where the currents I on the inner conductor 6 and on the antenna element 10 correspond mutually in value and phase. No current then flows in the inner conductor 7 of the second coaxial cable 5, 7, as shown in FIG. 3. In this operating condition, the vertically polarized electromagnetic oscillation is only passed by the first wave-guiding assembly 2.

Figure 4:
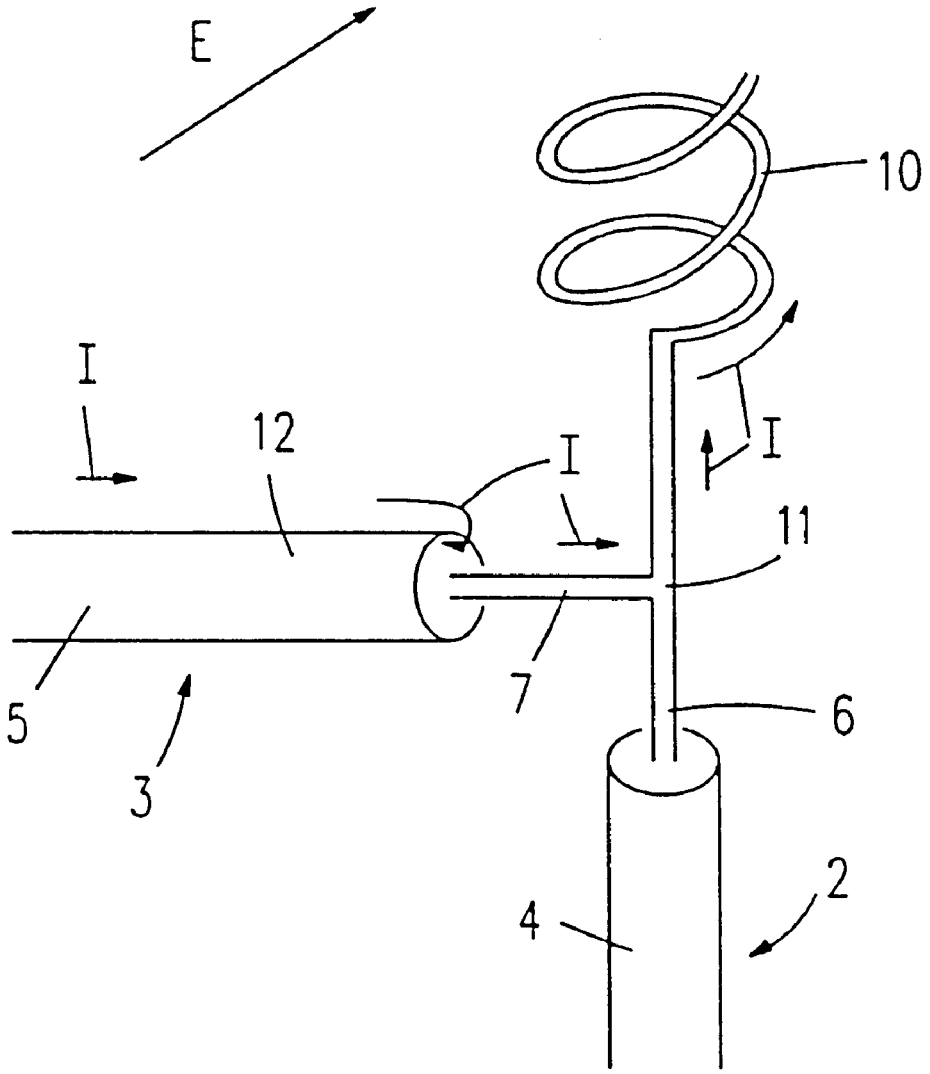
FIG. 4 shows yet another operating condition of the device shown in FIG. 1 where the received electromagnetic signal has both horizontal and vertical polarizations.

A comparison of FIGS. 2 and 3 shows that the currents I flow in opposite directions in the first coaxial cable 4, 6, given the dimensions and polarizations of the electric field vector E as shown. A suitable linear combination of components of the electromagnetic oscillation having horizontal and vertical polarizations is capable of achieving an operational condition as shown in FIG. 4, where the currents in the first coaxial cable 4, 6 cancel one another out. A current I then only flows in the second coaxial cable 5, 7 and the antenna element 10. The electric field vector E then assumes a polarization direction as sketched in FIG. 4, which lies between those of the operating conditions of FIGS. 2 and 3, i.e. between the horizontal and the vertical polarization.

The polarization in the operating condition of FIG. 4 is electrically perpendicular to the polarization in the operating condition of FIG. 3. It is not the spatial alignment of the electric field vector E in two spatially mutually perpendicular directions which determines this perpendicular arrangement, but rather the fact that in the operating condition of FIG. 3 the second coaxial cable 5, 7, and thus the second wave-guiding assembly 3 is without current, whereas in the operating condition of FIG. 4 the first coaxial cable 4, 6, and thus the first wave-guiding assembly 2 is without current.

Generally speaking, it is not necessary for the currents in the first coaxial cable 4, 6 and the antenna element 10 to be identical in the case of vertical polarization, as in FIG. 3, in order to obtain two operating conditions with perpendicular alignments of the induced currents. It is merely necessary that the vectors representing the currents in the inner conductors 6, 7 forming the supply devices should be linearly independent of one another in order to generate two operating conditions in which only one of the wave-guiding assemblies 2, 3 receives a current induced by the electromagnetic oscillation at any time. This is possible also for a larger number of supply devices and associated wave-guiding assemblies.

Figure 5:
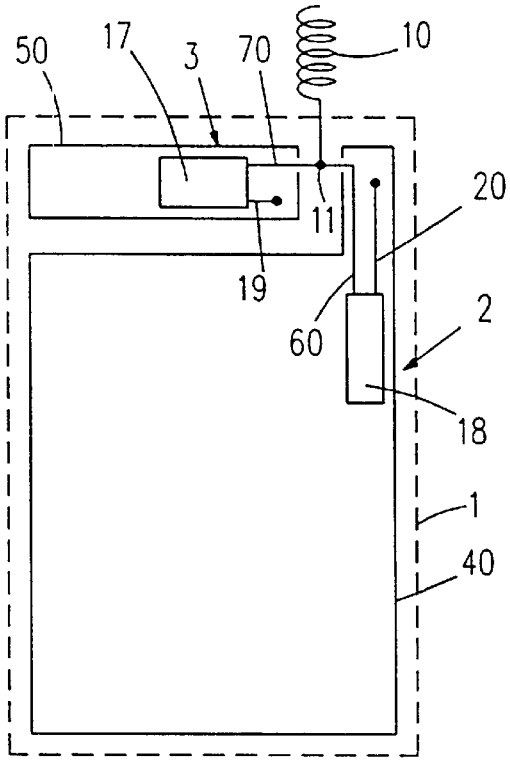
FIGS. 5 and 6 show two further embodiments of the device according to the invention.

FIG. 5 shows a second embodiment of the device according to the invention in diagrammatic representation with the housing 1, the wave-guiding assemblies 2, 3, and the antenna element 10. The conductor part of the first wave-guiding assembly 2 designed for radiating or receiving electromagnetic oscillations is formed by a conductive ground plane 40 here, which serves as a ground connection for a circuit arrangement 18 forming part of the first wave-guiding assembly 2. This circuit arrangement 18 and the conductive ground plane 40 are accordingly interconnected by means of a connection 20. The circuit arrangement 18 is designed for receiving and/or providing an electromagnetic oscillation.

Similarly, the conductor part of the second wave-guiding assembly 3 designed for receiving or radiating an electromagnetic oscillation is formed by a conductive ground plane 50 which is provided as a common ground conductor or screen for a circuit arrangement 17 for receiving and/or providing an electromagnetic oscillation. The circuit arrangement 17 also forms part of the second wave-guiding assembly 3. The circuit arrangement 17 and the conductive ground plane 50 are conductively connected to one another by means of the connection 19.

A supply device 60, 70 leads from each wave-guiding assembly 2, 3, and in particular from the circuit arrangement 17, 18 thereof, to the connection point 11 of the antenna element 10.

The conductive ground plane 40 of the first wave-guiding assembly 2 in the example of FIG. 5 is substantially vertically aligned, whereas the conductive ground plane 50 of the second wave-guiding assembly 3 is substantially horizontally aligned. Correspondingly, these conductive ground planes 40, 50 receive or radiate substantially vertically (ground plane 40) and horizontally (ground plane 50) polarized electromagnetic oscillations. If the device of FIG. 5 is used, for example, as a mobile telephone in which the antenna element 10 is arranged in the usual position at the upper side of the housing 1, the conductor part 50 of the second wave-guiding assembly 3 will lie substantially in the upper portion of the housing 1, while the conductor part 40 of the first wave-guiding assembly 2 will lie substantially in the lower part of the housing 1. These conductive ground planes 40, 50 again act as strip conductor antennas, while the antenna element 10 in FIG. 5 is constructed as a helical coil again. The current in the conductive ground plane 40 of the first wave-guiding assembly 2, generated during transmission or reception of an electromagnetic oscillation, preferably flows in the vertical direction, whereas the current in the ground plane 50 of the second wave-guiding assembly 3 flows preferably in the horizontal direction. Portions of the electromagnetic oscillation which are mutually at least substantially perpendicularly directed are accordingly transmitted or received. The conductor parts 40 and 50 are, as were the coaxial cables 4, 6 and 5, 7 in FIG. 1, sufficiently widely spaced apart from one another so that currents in one of the conductor parts 40, 50 do not stray into the other conductor part.

Preferably, both the conductor parts 40, 50, the coaxial cables 4, 6 and 5, 7 in FIG. 1, and the antenna element 10 each have an electric length which corresponds at least substantially to one-fourth the wavelength of the electromagnetic oscillation to be transmitted or received. The main dimensions of the conductor parts 40, 50 are substantially defined thereby.

Figure 6:
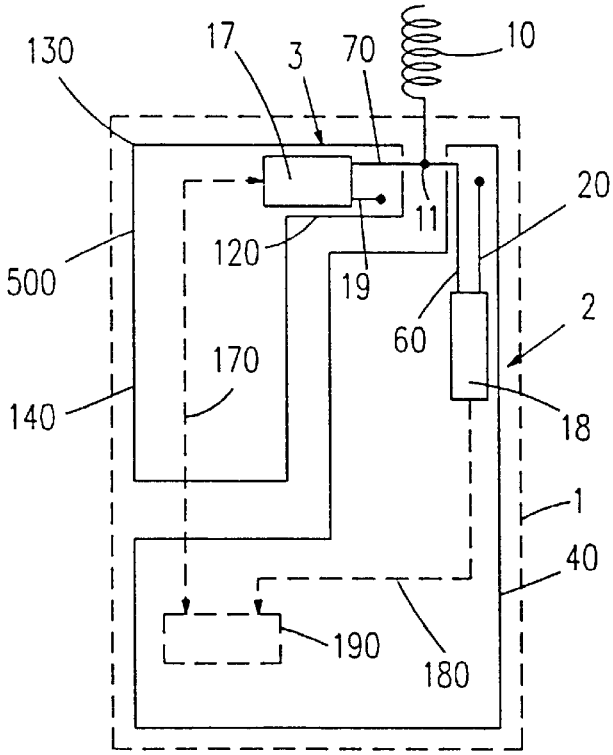

FIG. 6 shows a modification of the embodiment of FIG. 5 in which the conductor parts 40, 50 have a different shape. In particular, the conductive ground plane 500 which replaces the conductive ground plane 50 of FIG. 5 comprises a first portion 120 in a horizontal direction and a second portion 140 in a vertical direction. The portions 120, 140 of the conductive ground plane 500 are conductively interconnected via a right angle 130 corresponding to the bend 13 in the embodiment of FIG. 1. The conductive ground plane 40 of the first wave-guiding assembly 2 has a void corresponding to the second portion 140 of the conductive ground plane 500, so that its vertical alignment is indeed substantially retained, but a horizontally aligned component is added which is found in the lower portion of the housing 1, facing away from the antenna element 10. The vertically aligned portion of the conductor part 40 and the also vertically aligned second portion 140 of the conductive ground plane 500 are again suitably spaced apart so as to avoid mutual interference.

The arrangement of the conductive ground planes 40, 500 sketched in FIG. 6 results in a so-called oblique polarization deviating from the vertical polarization of the electromagnetic oscillation to be transmitted or received.

It is apparent from the dimensioning of the conductor parts of the wave-guiding assemblies 2 and 3, in particular the vertically aligned portions thereof, that the constructional dimensions thereof do not exert a very critical influence on the function of the device according to the invention.

As compared with a prior art device, accordingly, a construction of the wave-guiding assemblies 2, 3 and of the circuit arrangement 17, 18 forming a part thereof should be provided in the device according to the invention which provides an electrical separation up to the connection via the connection point 11 for the electromagnetic oscillation to be transmitted or received. Any circuit connections between the wave-guiding assemblies 2, 3 should accordingly be incapable of transmitting the electromagnetic oscillation, up to the connection point 11. This, however, requires no more than a minor additional constructional expenditure in practice.

When the device according to the invention is used, for example, as a mobile telephone, the electromagnetic oscillation contains a useful signal, for example a speech signal. The wave-guiding assemblies 2, 3, and in particular the circuit arrangements 17, 18 forming a part thereof, are then designed for capturing this useful signal when the wave-guiding assemblies 2, 3 are constructed for receiving the electromagnetic oscillation through the associated supply devices 60, 70. As is diagrammatically depicted in FIG. 6 with the connections 170 (to 17) and 180 (to 18), the useful signal may be made available by the circuit arrangements 17 and 18 for further processing in a circuitry unit 190. This circuitry unit is shown in the region of the ground plane 40 in FIG. 6 for reasons of space, but it may alternatively be connected to the circuit arrangement 18 in a modification of the example of FIG. 6, or it may be accommodated in the housing 1 spatially separated from the wave-guiding assemblies 2, 3, and also electrically separated therefrom as regards the electromagnetic oscillation. When the electromagnetic oscillation is received through the antenna element 10 and the wave-guiding assemblies 2, 3, the circuit arrangements 17, 18 will make the useful signal available with different transmission qualities, i.e. in particular with different amplitudes, in dependence on the spatial alignment of the appliance. An automatic selection may then preferably take place in the circuitry unit 190 such that a useful signal of sufficient amplitude and also sufficient signal-to-noise ratio is available at all times. This is also referred to as "antenna diversity".

In a device according to the invention, inversely, in which the wave-guiding assemblies 2, 3 are constructed for providing each an electromagnetic oscillation through the associated supply devices 60, 70, at least part of the wave-guiding assemblies may be constructed for introducing a useful signal into the accompanying electromagnetic oscillation. In the embodiment of FIG. 6, it is preferably both wave-guiding assemblies 2, 3 in which the useful signal—preferably a speech signal—is introduced into an electromagnetic oscillation, i.e. is modulated therewith. The electromagnetic oscillations thus formed and containing the useful signal are jointly supplied to the connection point 11 of the antenna element 10 by the wave-guiding assemblies 2, 3 via the associated supply devices 60, 70. The polarization of the electromagnetic oscillation transmitted by the device of FIG. 6 may then be influenced through a control of the amplitudes and or phases of the electromagnetic oscillations containing the useful signal by means of the circuitry unit 190 via the connections 170, 180.

In a modification of the embodiments of FIGS. 1, 5, and 6, a switch may be interposed in each supply device 60, 70 or inner conductor 6, 7, whereby the wave-guiding assemblies 2, 3 can be electrically separated from the connection point 11, as desired. It is thus possible, for example, to connect only one of the wave-guiding assemblies 2, 3 to antenna element 10 at a time, as desired. Such switches may preferably be constructed as PIN diodes which are series-connected in the supply devices 60, 70 or 6, 7 in the longitudinal direction. In particular, these PIN diodes may form a part of the circuit arrangements 17, 18. These circuit arrangements 17, 18 may in that case comprise additional control circuits by means of which the PIN diodes can be switched into the conducting or non-conducting state in dependence on the amplitude of an electromagnetic oscillation received by the associated wave-guiding assembly 2, 3. This control may alternatively be performed by the circuitry unit 190, if so desired.

Instead of the direct electrical connections between the wave-guiding assemblies 2, 3 and the antenna element 10 as shown in FIGS. 1–6, connections across (small) impedances may also be used, for example, also across inductances or capacitances.

What is claimed is:

1. An electromagnetic radiation apparatus comprising:

an antenna element which receives electromagnetic radiation and is connected to a connection point of said electromagnetic radiation apparatus;

a processing circuit which is connected to said connection point by a first supply device and a second supply device to receive said electromagnetic radiation;

a first conductive part configured to receive a first polarization of said electromagnetic radiation and provide said first polarization to said processing circuit; and a second conductive part configured to receive a second polarization of said electromagnetic radiation and provide said second polarization to said processing circuit;

wherein said first conductive part and said second conductive part respectively are one of coaxial outer conductors of said first supply device and said second supply device, and an elongated first ground plane and an elongated second ground plane connected to said processing circuit.

2. The electromagnetic radiation apparatus of claim 1, wherein said processing circuit selects a desired one of said first polarization and said second polarization for further processing.

3. The electromagnetic radiation apparatus of claim 1, further comprising a housing which contains said first conductive part and said second conductive part, said housing allowing reception of said electromagnetic radiation.

4. The electromagnetic radiation apparatus of claim 1, wherein said first conductive part is an outer conductor of a coaxial cable and said first supply device is an inner conductor of said coaxial cable.

5. The electromagnetic radiation apparatus of claim 1, wherein said first conductive part is along a first axis which is parallel to an antenna axis of said antenna element and wherein said second conductive part is along a second axis which is perpendicular to said first axis.

6. The electromagnetic radiation apparatus of claim 1, wherein said first conductive part is along a first axis which is parallel to an antenna axis of said antenna element to receive said first polarization; and wherein said second conductive part has a first portion which is perpendicular to said first axis to receive said second polarization, and a second portion which parallel to said first axis to receive said first polarization.

7. The electromagnetic radiation apparatus of claim 1, wherein said elongated first ground plane is along a first axis which is parallel to an antenna axis of said antenna element to receive said first polarization, and wherein said elongated second ground plane along a second axis which is perpendicular to said first axis to receive said second polarization.

8. The electromagnetic radiation apparatus of claim 1, wherein said first elongated ground plane is along a first axis which is parallel to an antenna axis of said antenna element to receive said first polarization; and wherein said second elongated ground plane has a first portion which is perpendicular to said first axis to receive said second polarization and a second portion which parallel to said first axis to receive said first polarization.

9. The electromagnetic radiation apparatus of claim 1, wherein each of said first conductive part and said second conductive part has a respective electric length of approximately one-fourth a wavelength of a corresponding frequency of said electromagnetic radiation.

10. An electromagnetic radiation apparatus comprising:

an antenna element which receives electromagnetic radiation;

a first waveguide assembly connected between said antenna element and a processing circuit by a first supply device; and a second waveguide assembly connected between said antenna element and said processing circuit by a second supply device;

wherein said first waveguide assembly has a first conductive part configured to receive a first polarization of said electromagnetic radiation; and wherein said second waveguide assembly has a second conductive part configured to receive a second polarization of said electromagnetic radiations;

wherein said first conductive part and said second conductive part respectively are one of coaxial outer conductors of said first supply device and said second supply device, and an elongated first ground plane and an elongated second ground plane connected to said processing circuit.

11. The electromagnetic radiation apparatus of claim 10, wherein said processing circuit selects a desired one of said first polarization and said second polarization for further processing.

12. The electromagnetic radiation apparatus of claim 10, further comprising a housing which contains said first waveguide assembly and said second waveguide assembly, said housing allowing reception of said electromagnetic radiation.

13. The electromagnetic radiation apparatus of claim 10, wherein said first waveguide assembly includes a coaxial cable and said first conductive part is an outer conductor of said coaxial cable, said coaxial cable having an inner conductor which connects said antenna element to a processing circuit, wherein said first polarization received by said outer conductor induces a current in said inner conductor.

14. The electromagnetic radiation apparatus of claim 10, wherein said first waveguide assembly includes a first coaxial cable and said second waveguide assembly includes a second coaxial cable;

said first conductive part being a first outer conductor of said first coaxial cable, and said second conductive part being a second outer conductor of said second coaxial cable;

said first coaxial cable having a first inner conductor which connects said antenna element to a processing circuit, and said second coaxial cable having a second inner conductor which connects said antenna element to said processing circuit;

wherein said first polarization received by said first outer conductor induces a first current in said first inner conductor, and said second polarization received by said second outer conductor induces a second current in said second inner conductor.

15. The electromagnetic radiation apparatus of claim 10, wherein said first conductive part is along a first axis which is parallel to an antenna axis of said antenna element and wherein said second conductive part is along a second axis which is perpendicular to said first axis.

16. The electromagnetic radiation apparatus of claim 10, wherein said first conductive part is along a first axis which is parallel to an antenna axis of said antenna element to receive said first polarization; and wherein said second conductive part has a first portion which is perpendicular to said first axis to receive said second polarization and a second portion which parallel to said first axis to receive said first polarization.

17. The electromagnetic radiation apparatus of claim 10, wherein said elongated first ground plane is along a first axis which is parallel to an antenna axis of said antenna element to receive said first polarization, and wherein said elongated second ground plane is along a second axis which is perpendicular to said first axis to receive said second polarization.

18. The electromagnetic radiation apparatus of claim 10, wherein said first elongated ground plane is along a first axis which is parallel to an antenna axis of said antenna element to receive said first polarization; and wherein said second elongated ground plane has a first portion which is perpendicular to said first axis to receive said second polarization and a second portion which parallel to said first axis to receive said first polarization.

19. The electromagnetic radiation apparatus of claim 10, wherein each of said first conductive part and said second conductive part has a respective electric length of approximately one-fourth a wavelength of a corresponding frequency of said electromagnetic radiation.

20. A cordless telephone comprising:

an antenna element which receives electromagnetic radiation;

a processing circuit which is connected to said antenna element by a first supply device and a second supply device to receive said electromagnetic radiation;

a first conductive part configured to receive a first polarization of said electromagnetic radiation and provide said first polarization to said processing circuit;

a second conductive part configured to receive a second polarization of said electromagnetic radiation and provide said second polarization to said processing circuit; and a housing which contains said first conductive part, said second conductive part and said processing circuit, said housing allowing reception of said electromagnetic radiation by said first conductive part and said second conductive part;

wherein said first conductive part and said second conductive part respectively are one of coaxial outer conductors of said first supply device and said second supply device, and an elongated first ground and an elongated second ground of said processing circuit.

* * * * *